United States Patent [19]

Clemens et al.

[11] Patent Number: 5,014,873

[45] Date of Patent: May 14, 1991

[54] BARREL OF THERMOPLASTIC MATERIAL

[75] Inventors: Werner Clemens, St. Augustin; Werner Daubenbüchel, Bergisch-Gladbach; Otto Eiselen, Königswinter; Erich Kiefer; Peter Klüsener, both of Bonn; Peter Teichmann, Siegburg-Kaldauen; Dirk Wehrens, St. Augustin, all of Fed. Rep. of Germany

[73] Assignee: Krupp Kautex Maschinenbau GmbH, Fed. Rep. of Germany

[21] Appl. No.: 569,889

[22] Filed: Aug. 20, 1990

[30] Foreign Application Priority Data

May 25, 1990 [DE] Fed. Rep. of Germany ..... 4016785

[51] Int. Cl.[5] ..... B65D 7/00

[52] U.S. Cl. ..... 220/601; 220/4.05

[58] Field of Search ..... 220/601, 5 R

[56] References Cited

U.S. PATENT DOCUMENTS

| | | | |
|---|---|---|---|
| 3,647,110 | 3/1972 | Hammes | 220/601 |
| 4,674,648 | 6/1987 | Przytulla | 220/5 R X |
| 4,736,862 | 4/1988 | Hammes et al. | 220/601 |
| 4,767,021 | 8/1988 | Pies | 220/5 R X |
| 4,776,479 | 10/1988 | Schütz | 220/5 R |
| 4,925,049 | 5/1990 | Przytulla | 220/5 R X |
| 4,934,551 | 6/1990 | Büdenbender | 220/5 R X |

*Primary Examiner*—Steven M. Pollard

*Attorney, Agent, or Firm*—Panitch, Schwarze, Jacobs & Nadel

[57] ABSTRACT

A barrel of thermoplastic material has at least one connecting portion having an emptying opening and arranged in a trough-like depression in the upper end part of the barrel. In the region of the connecting portion the barrel has at least one inclined surface which extends between the upper end part of the barrel and the side wall of the barrel. The inclined surface is of such a configuration that in a barrel emptying position the emptying opening forms the lowest part of the interior of the barrel to permit at least almost complete emptying of the barrel.

23 Claims, 4 Drawing Sheets

BARREL OF THERMOPLASTIC MATERIAL

BACKGROUND OF THE INVENTION

The invention concerns a barrel of thermoplastic material.

It will be noted here that the term barrel is used herein in a broad sense to embrace various forms of barrel-like container including drums, casks and the like.

A barrel is subjected to various requirements in regard to the structure and performance thereof, of which hitherto those which have been considered to be most important are an adequate level of resistance to the effects of external forces, for example due to shocks, blows or stresses due for example to the barrel being dropped. Those aspects have to be taken into account in designing the barrel configuration.

A barrel of typical design is generally provided with rings which extend around the barrel and which are disposed at a spacing from the upper and lower ends respectively, for more convenient handling of the barrel. It may also be necessary for a plurality of barrels to be stacked one upon the other so that the upper and lower ends of each barrel must provide a sufficient stable surface on which the barrel can stand and can also support another barrel. For that purpose, the upper end of the barrel, which has a connecting or nozzle portion defining an emptying opening, may have a generally trough-like depression in which the connecting or nozzle portion is accommodated, whereby the upper end of the barrel provides the required support surface. That arrangement also provides that the projecting connecting or nozzle portion, by virtue of being accommodated in the depression, is substantially protected from the effects of external forces acting on the barrel.

In regard to taking account of environmental requirements, increasing attention is now also being paid to the requirement that a barrel of that kind can be totally emptied in order to ensure that any residual amounts of the contents of the barrel, which still remain therein after the barrel has been emptied, cannot pass uncontrolledly into the environment and thus give rise to pollution.

However, arranging the connecting or nozzle portion of the barrel, as referred to above, within a trough-like depression, gives rise to the disadvantage that, when the barrel is in the usual inclined position adopted for emptying thereof, the inside surface of the barrel includes regions, beside the trough-like depression configuration, which are lower in that position of the barrel than the lowest region of the barrel emptying opening, on the inside wall surface of the barrel. Therefore, in order to ensure that a barrel or like container is emptied as completely as possible, the connecting or nozzle portion may be arranged closely adjacent to the wall of the barrel so that, when the barrel is in the usual inclined position for emptying thereof, on the inside of the barrel there are no points which are lower than the lowest region, on the inside of the barrel, of the generally round emptying opening of the barrel. However, arranging the connecting portion in the immediate vicinity of the side wall of the barrel in that way in turn gives rise to the difficulty that, even when the connecting or nozzle portion is disposed in a trough-like depression in the upper end part of the barrel, the connecting or nozzle portion is less protected against forces which act on the barrel from the exterior thereof, laterally in relation thereto. That consideration applies both in regard to forces which act directly on the connecting portion and also in regard to loadings which act on the edge or the side wall of the barrel and which are produced for example in the event of the barrel dropping from a considerable height. The resulting deformation of the edge or rim of the barrel or the side wall thereof inevitably also affects the connecting portion of the barrel and the region of the upper end part of the barrel which carries the connecting portion, thus giving rise to stress peaks in that region which can result in splits and other damage to the barrel.

Those difficulties could be reduced for example by arranging the barrel in such a way that the connecting portion extends into the interior of the barrel by a certain amount. That provides that on the one hand the upwardly projecting part of the connecting portion can be shorter while on the other hand the depth of the depression which accommodates the connecting portion can be reduced whereby the surface area available for external forces to act thereon can be decreased. In that case the inwardly extending part of the connecting portion must be sufficiently long to provide a sufficiently firm fit for a closure plug or stopper which is screwed into the connecting portion and more specifically into a female screwthread provided therein for that purpose. It will be appreciated however that that part of the connecting portion which extends into the interior of the barrel constitutes on the inside of the barrel a shielding or screening means around the emptying opening so that after emptying of the barrel the barrel still contains an amount of the previous contents thereof, which depends on the axial extent of the part of the connecting portion which projects into the interior of the barrel. It is not possible for a barrel with a connecting portion of that kind to be completely or almost completely emptied.

EP-A-0 291 695 discloses a barrel provided with such a connecting portion, wherein the part thereof which projects into the interior of the barrel has openings therein which extend as far as the inner boundary wall of the trough-like depression. In that way the residual material left in the barrel can flow towards the emptying opening of the barrel without the inwardly extending part of the connecting portion representing a screening means around the emptying opening, to prevent material from flowing therethrough. However connecting portions of that kind must be fitted to the finished barrel in the form of separate components so that the junction can under some circumstances represent a weak point which could be damaged or caused to fail in the event of the barrel being subjected to the influence of considerable external forces. Furthermore the design configuration of that connecting portion involves an increased level of production cost which can have an effect on the economy of the barrels which are usually produced in large numbers. In addition, with a barrel of that design configuration, in order to provide for emptying which is as complete as possible, the trough-like depression must be so designed that the surface area of the upper end part of the barrel, which serves as a support surface, is accordingly reduced.

SUMMARY OF THE INVENTION

An object of the present invention is to provide a barrel of thermoplastic material such that it can be at least approximately completely emptied.

Another object of the present invention is to provide a barrel of thermoplastic material which is so designed that it can be almost totally emptied without production thereof being complicated and while also affording ease of handling in an emptying operation.

Still another object of the present invention is to provide a barrel of thermoplastic material which can be readily at least almost totally emptied while at the same time affording damage protection for the connecting portion of the barrel on the upper end part thereof.

Still a further object of the present invention is to provide a barrel of thermoplastic material which can be at least almost completely emptied and which is also readily stackable in a stable condition.

In accordance with the present invention those and other objects are attained by a barrel of thermoplastic material having an upper end part carrying a connecting or nozzle portion or emptying stub portion with an emptying opening defined thereby, being disposed in a trough-like depression in the upper end part of the barrel. The barrel is provided with at least one circumferential ring extending at a spacing from the upper and lower ends thereof, to provide for facilitated handling of the barrel. The barrel has a portion between its upper end part and the adjacent ring, which portion in the region of the at least one emptying opening is provided with at least one inclined surface which is inclined towards the ring when the barrel is standing upright with its upper end part upwards, the inclined surface intersecting the depression between the connecting or nozzle portion and the adjacent ring laterally beside the depression. The extent of the inclined surface is so selected that in an emptying position of the barrel in which it is inclined through more than 90° relative to the upright position thereof, no point in the interior of the barrel is lower than the lowest region of the emptying opening, at the inside wall Of the barrel. Thus the configuration of the inclined surface referred to above, depending on the configuration of the portion of the barrel between the upper end part and the ring thereof, approximately corresponds to an inclined sectional surface of a cylinder or cone.

It is desirable for the inclined surface to be disposed symmetrically with respect to the emptying opening.

In one embodiment of the barrel according to the invention the inclined surface may be of a flat configuration. However such a design configuration requires that the barrel be precisely held in the appropriate angular position in an emptying operation, both in relation to the axis of tilting movement of the barrel and also in relation to a turning movement, for example around the axial center line of the barrel. In order to ensure that the content of the barrel does not accumulate inside the barrel beside the emptying opening in the event of the barrel being turned slightly about its axial center line, it is desirable for the inclined surface to be divided into first and second surface portions which are arranged in a slightly turned or pivoted position relative to a dividing line which extends radially with respect to the cross-section of the barrel so that on the inside of the barrel the first and second surface portions include an angle which is somewhat less than 180°. That arrangement ensures that the barrel can be at least approximately completely emptied, even in the event of the barrel being turned slightly about its axial center line, as the lowest region of the emptying opening is in the groove or channel configuration defined by the first and second surface portions.

It may also be advantageous for the inclined surface to be divided into first and second surface portions which are arranged to be turned or pivoted slightly with respect to a chord extending through the lowest region of the emptying opening so that on the inside of the barrel the first and second surface portions include an angle which is somewhat less than 180°. In that way the barrel can be almost completely emptied even if the position of tilting thereof deviates slightly from the optimum barrel-emptying position.

It will be appreciated consequently that it is also possible for the inclined surface to be divided in such a way that the first and second surface portions thereof which are arranged such that they are turned slightly with respect to an approximately radial dividing line are additionally each divided into first and second surface portions which are arranged in such a way as to be turned or pivoted slightly with respect to the above-mentioned chord. Accordingly the inclined surface is composed of four surface portions forming a funnel-like pyramid, the lowest point of which corresponds to the lowest region of the emptying opening. In that way it is possible for the barrel to be at least approximately totally emptied, even in the event of the barrel being turned or pivoted slightly out of its optimum position for emptying thereof.

At any event the barrel can be put into an optimum emptying position in which it can be satisfactorily emptied without additional steps, apart naturally from those components of the contents of the barrel, which remain clinging to the inside wall surface thereof.

In an advantageous feature the inclined surface may be provided with a channel-like depression on the inward surface of the barrel and extending radially with respect to the emptying opening and communicating with the emptying opening, thereby also making it possible to simplify the operation of at least almost completely emptying the barrel.

The inclined surface may desirably also be of such a configuration that it blends directly into the side wall and the upper end part of the barrel, without leaving a step or shoulder at that location, thereby avoiding the presence of pockets within which material in the barrel could otherwise accumulate.

It is also possible for the inclined surface or the above-mentioned surface portions constituting same to be of a slightly convexly curved configuration on the inside of the barrel, in which case the apex line or lines of the respective surface portions corresponds or correspond to the above-mentioned dividing lines.

The inclined surface referred to above will generally preferably be of such a configuration that the apex thereof, which is on the outside wall of the barrel, is arranged adjacent the handling ring on the barrel and the surface extends beside the emptying opening as far as the corresponding, possibly conically extending side wall of the portion of the barrel between the upper end part thereof and the ring adjacent thereto, that portion of the barrel being an upper end portion when the barrel is in an upright position. In order to provide an advantageous angle of inclination, it may possibly be necessary for the handling ring to be arranged at a greater spacing from the upper end part of the barrel, than is the generally conventional practice. However that does not affect handling of the barrel to any substantial extent. In addition, when the barrel has two oppositely disposed openings, in the upper end part thereof, a respective inclined surface as set forth above may be associated with each opening.

The design configuration of the barrel according to the invention permits the barrel to be readily completely emptied while at the same time to protect the connecting portion from damage, the connecting portion may be disposed on the upper end part of the barrel at a spacing from the side wall thereof.

However arranging an inclined surface as referred to above in the region of the portion of the barrel between the upper end part and the handling ring thereof means that on the one hand the support surface area afforded by the upper end part of the barrel is reduced while on the other hand the part of the connecting portion which projects with respect to the contour of the barrel has less protection.

The invention can therefore further provide at least one supplementing body portion which is of such a configuration and which is disposed on the inclined surface in such a way that it at least approximately compensates for the reduction in the substantially horizontal support surface afforded by the upper end part of the barrel, such reduction being due to the presence of the inclined surface referred to above. On the other hand, it may also advantageously be of such a configuration that at the same time it affords substantial protection for the connecting portion from the effect of external forces acting on the barrel.

In accordance with a preferred feature of the invention, the supplementing body portion is of such a configuration that its surface which is the lower surface in the upright position of the barrel corresponds to the upwardly facing contour of the inclined surface while the upper surface of the supplementing body portion in the operative position thereof extends substantially horizontally and in alignment with the surface of the upper end part of the barrel, which forms the barrel support surface. In that connection it is possible for the supplementing body portion to have a plurality of vertical ribs or a vertically disposed grid or lattice structure, the upper boundary of which aligns with the horizontal surface of the upper end part which serves as the barrel support surface.

The supplementing body portion may be produced for example by injection molding or blow molding or in any other suitable fashion, and may be hollow or solid. In order for the supplementing body portion to be capable of carrying the loadings that it may encounter, it is desirable for it to be glued or welded to the barrel. As generally a barrel of thermoplastic material of the kind referred to above is produced by means of blow molding, wherein a substantially tubular preform is expanded under the effect of an increased internal pressure in a divided blow-molding mold defining a mold cavity, it may be desirable for the supplementing body portion to be introduced into the blow-molding mold prior to the procedure for expanding the preform. In that way it is possible to provide for particularly good adaptation of the lower side or surface of the supplementing body portion to the adjacent external contour of the inclined surface at the upper end of the barrel. If the supplementing body portion and the barrel also comprise plastic materials which can be welded together, it is possible in that way to provide for a particularly firm union between the two components.

Further objects, features and advantages of the present invention will be apparent from the following description of preferred embodiments thereof.

DESCRIPTION OF PREFERRED EMBODIMENTS

Figure 1:
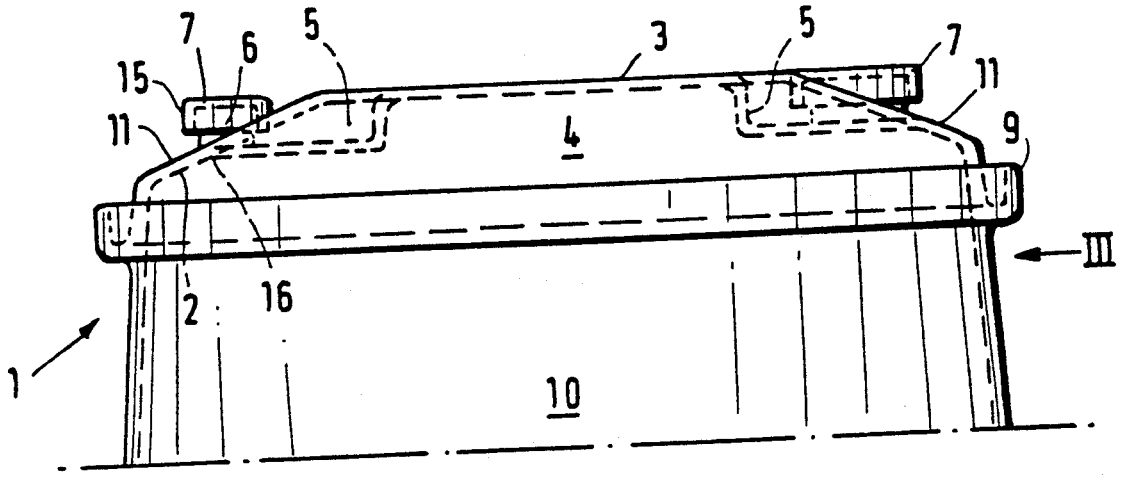
FIG. 1 is a side view of part of a barrel according to the principles of the present invention.
Figure 2:
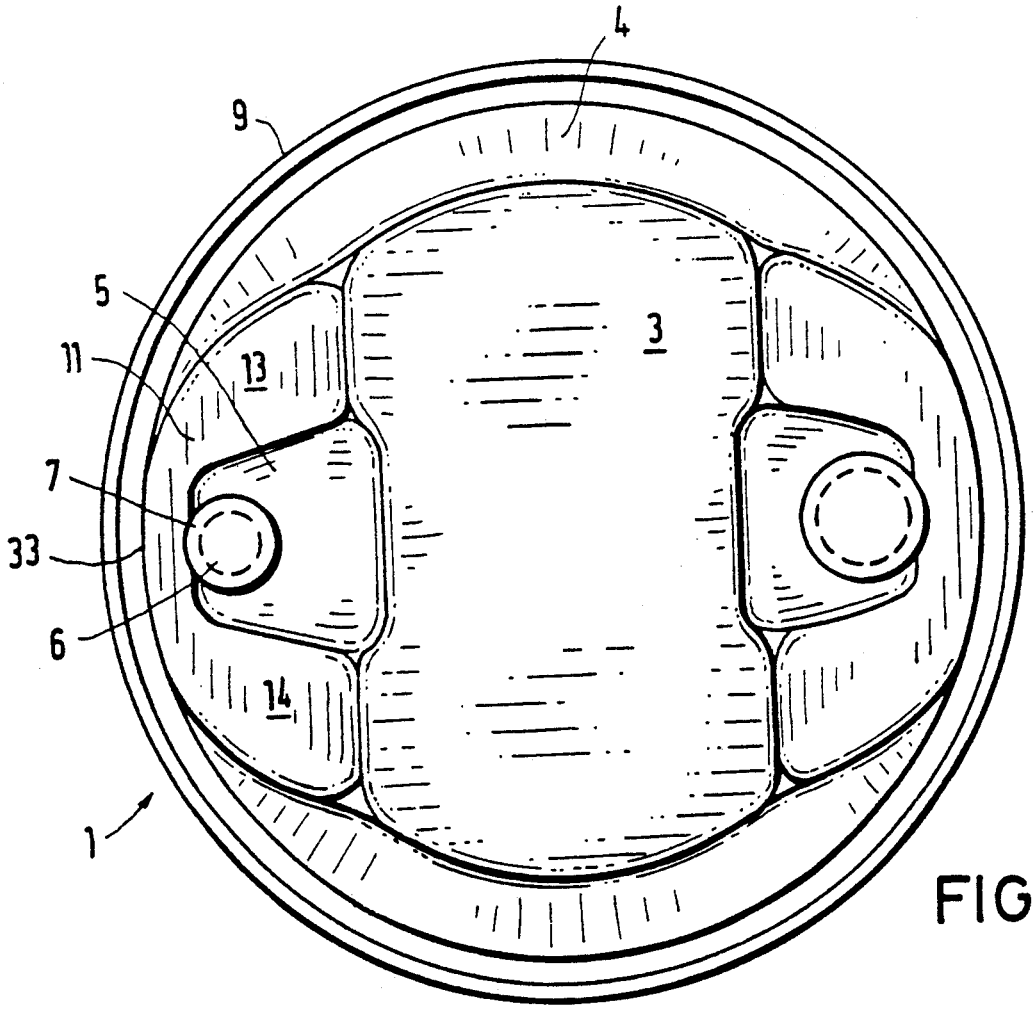
FIG. 2 is a plan view of the structure shown in FIG. 1.

Referring firstly to FIGS. 1 and 2, a barrel 1 as illustrated therein comprises a body 10 defined by a side wall, an upper end part 3 and a lower end part (not shown). Arranged at a spacing from the upper end part 3 of the barrel 1 is a circumferential ring 9 which can be engaged for example by barrel-handling means. At two oppositely disposed sides, as can be clearly seen for example from FIG. 2, the upper end part 3 of the barrel 1 is provided with respective trough-like depressions 5 within which are disposed respective connecting or nozzle portions 7 defining an emptying opening 6. The portions 7 are referred to as connecting portions herein although it will be appreciated that they may merely be used for emptying the barrel without involving connection of a further component thereto, apart possibly from a closure plug or cap in order to seal the barrel closed, the plug being removable to empty the barrel.

It will be seen that the barrel illustrated in FIGS. 1 and 2 has first and second connecting portions 7 with emptying openings 6 of different diameters. It will be appreciated that the connecting portions 7 may also be of the same sizes, and the barrel may also have a connecting portion 7 only at one side thereof.

Figure 3:
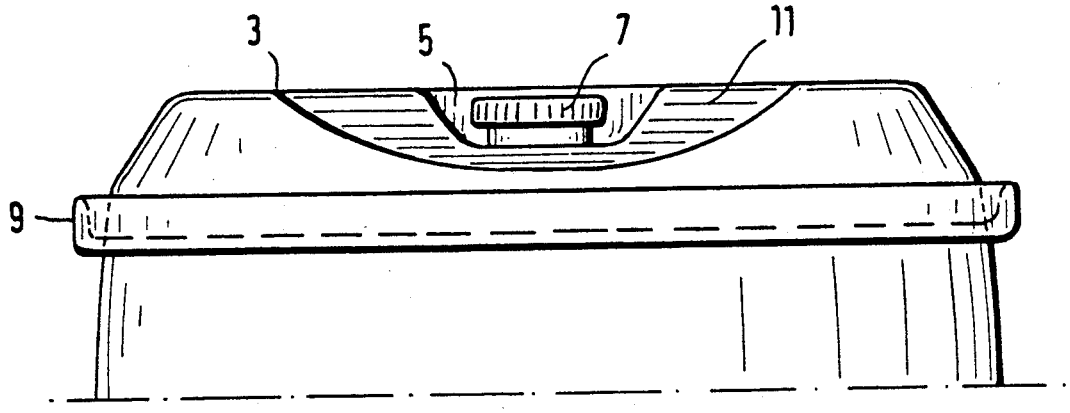
FIG. 3 is a front view looking in the direction of the arrow III in FIG. 1.

In the region of the connecting portions, the part 4 of the barrel, which is between the upper end part 3 and the circumferential ring 9 and which is of a generally conical or tapering configuration, as can be clearly seen for example from FIG. 3, has respective inclined surfaces 11 which each extend approximately as far as the ring 9. As shown in FIG. 1, the inclination and the extent of each inclined surface 11 is so selected that the inclined surface 11 adjoins a region indicated at 16 in FIG. 1 of the emptying opening 6, which, when the barrel is in an emptying position, represents the lowest region of the emptying opening 6, on the inside wall of the barrel. The inclination of the inclined surface 11 depends inter alia on the spacing of the side 15 of the connecting portion 7, which is towards the outside wall of the barrel, from that outside wall, and the spacing of the circumferential ring 9 from the upper end part 3 of the barrel. The angle of inclination of the inclined surface 11 may be for example around 45° .

References 13 and 14 in FIG. 2 identify surface portions or regions of the inclined surface 11, which extend beside the trough-like depression 5 in the upper end part 3 of the barrel and which extend as far as the boundary wall of the upper portion 4 of the barrel, between the end part 3 and the ring 9. As in the case of a conventional barrel, as illustrated in the drawing the portion 4 is of a conical or tapering configuration as that is advantageous in regard to engagement of a handling apparatus with the ring 9. It is possible however for the portion 4 of the barrel to have at least approximately vertical side walls and thus to be of a substantially cylindrical form.

The geometrical definitions set forth in this description are only intended to serve for providing a better description of the geometrical configuration involved. A barrel as described and illustrated herein does not in any case precisely correspond to the specified geometrical shapes as, after the process for the production of such a barrel from thermoplastic material, for example by means of blow molding, during the cooling phase, the barrel tends to experience deformation effects which are unforeseeable and which are not strictly geometrical, resulting in deviations from the precise geometrical shapes referred to.

Figure 5A:
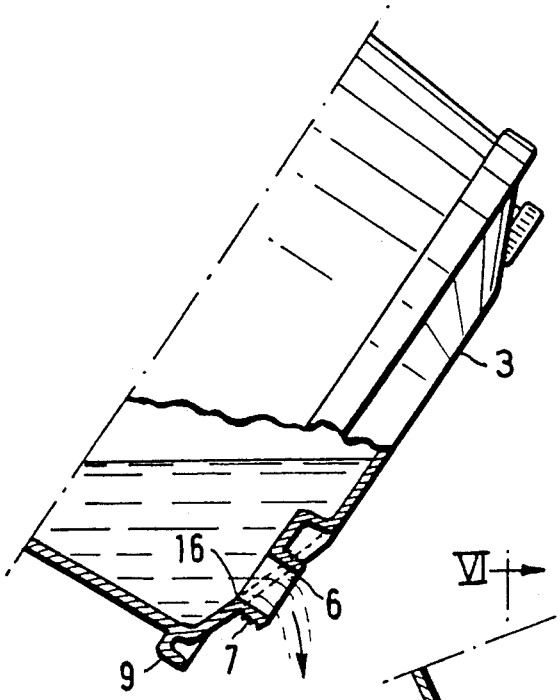
FIGS. 5*a* through 5*c* show partly sectional views of a barrel according to the invention in three successive positions adopted by the barrel in the course of emptying thereof.
Figure 5B:
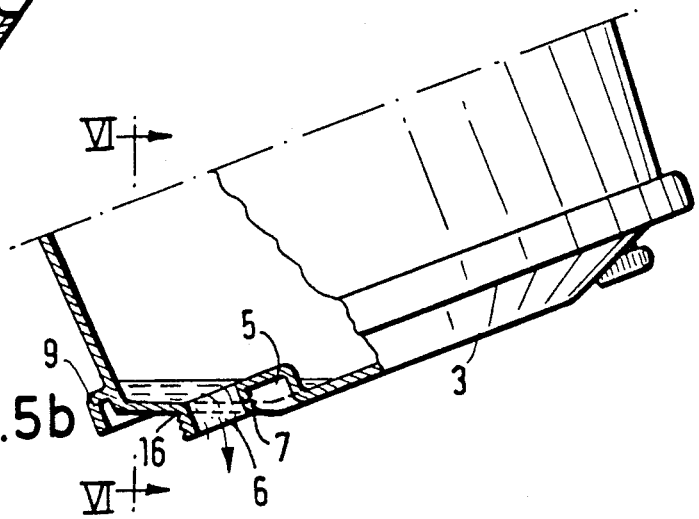
Figure 5C:
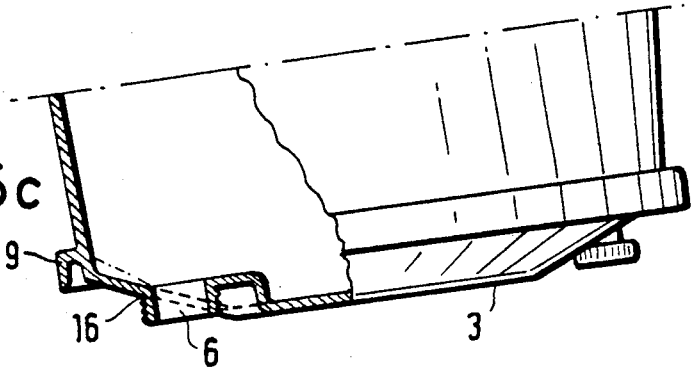

Reference will now be made at this point to FIGS. 5*a* through 5*c* showing a barrel emptying operation with the barrel in different inclined positions. The emptying procedure will be self-evident from the drawing and it will be further appreciated that arranging the inclined surface 11 in the portion 4 of the barrel can provide an optimum emptying position, as illustrated in FIG. 5*b*, in which there is no point in the interior of the barrel which is at a lower level than the lowermost region 16 of the emptying opening 6, at the inside wall surface of the barrel.

Figure 4:
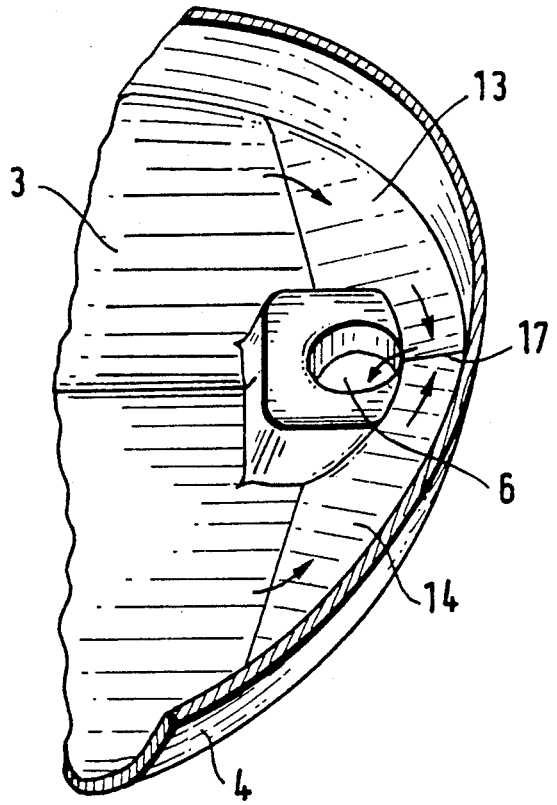
FIG. 4 is a view of the inside of another embodiment of a barrel according to the invention.
Figure 7:
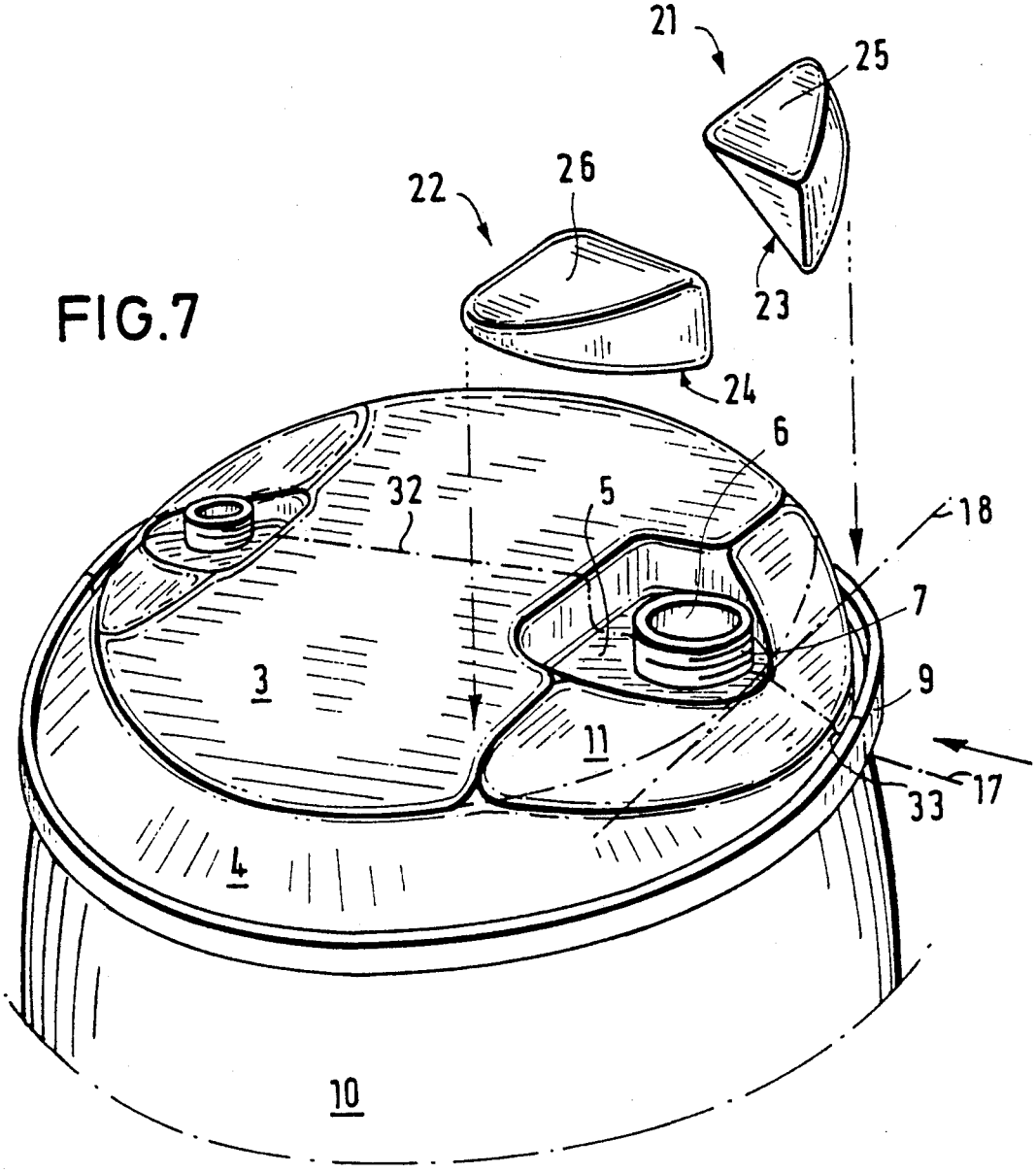
FIG. 7 shows a further embodiment of a barrel with supplementing body portions.

Referring now to FIG. 4, it will be clear therefrom that by virtue of the surface portions 13 and 14 being arranged in such a way as to be turned or pivoted slightly inwardly of the barrel about an at least approximately radially extending dividing line indicated at 17 in FIG. 4 and also in FIG. 7, it will be possible for the barrel to be almost completely emptied even if the barrel is turned about its axial or longitudinal center line in such a way that in the tilted position of the barrel for emptying thereof, the dividing line 17 no longer extends through the lowermost point on the inside of the wall of the barrel.

Figure 6:
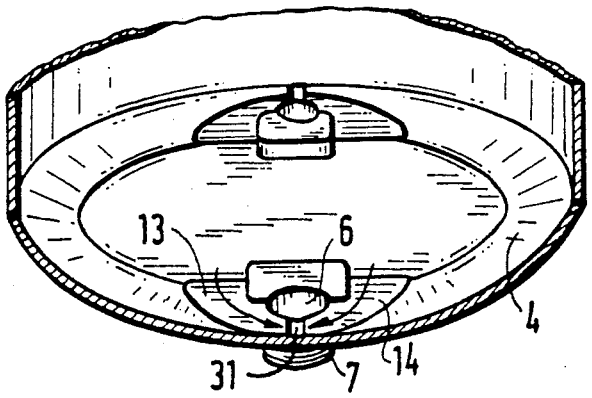
FIG. 6 is a view in section taken along line VI—VI in FIG. 5*b*.

A similar effect is achieved by virtue of the configuration shown in FIG. 6 to which reference is now directed, illustrating that in addition the inclined surface 11 may have a radially extending channel-like depression indicated at 31, which extends from the side wall of the barrel to the emptying opening 6 thereof. That configuration can provide for a simplification in the emptying procedure, by facilitating the flow of the contents of the barrel into the emptying opening.

In regard also to further simplifying a barrel emptying operation, reference may be made to FIG. 7 showing that the surface portions identified at 13 and 14 in FIG. 2 may be subdivided into two further surface portions which are arranged in such a way as to be slightly turned or pivoted about a chord indicated at 18 in FIG. 7, which extends at least approximately through the point of the depression 5 or the emptying opening 6, which is most closely adjacent to the outer or side wall of the barrel. That configuration further simplifies the emptying procedure in that the emptying opening 6, with at least a part of its circumference on the inward side of the wall of the barrel, represents the lowest region in the emptying position even if the barrel deviates slightly from the optimum emptying position shown in FIG. 5*b*, in regard to the tilted position of the barrel. The configuration of the surface portion disposed radially outwardly of the chord 18 in FIG. 7 is also indicated in FIG. 5*c* by the dash-dotted line extending between the edge of the emptying opening 6 and the edge of the circumferential ring 9.

It should be noted at this point that it is also possible for the inclined surface 11 to be divided only in relation to the chord 18.

The maximum permissible extent of deviations of the position of the barrel from the optimum position of emptying thereof, both in regard to tilting movement of the barrel and also in relation to a turning movement of the barrel about its axial center line, is achieved at any event when one of the surface portions is in a horizontal position and upon a further deviation the emptyinq opening does not form the lowest region of the barrel with any part of its periphery which is towards the inside wall of the barrel.

Figure 8:
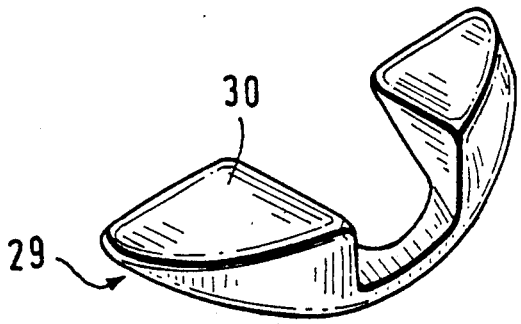
FIG. 8 shows another embodiment of the supplementing body portion.

Referring to FIGS. 7 and 8, in order to provide protection for the laterally exposed connecting portion or portions 7, the barrel 1 may be fitted with supplementing body portions indicated at 21 and 22 which are suitably fixed on to the appropriate inclined surface 11 as by adhesive or welding. The bottom sides or surfaces 23 and 24 of the supplementing body portions 21 and 22, which face towards the inclined surface 11 in the fitted position of the supplementing body portions 21 and 22, are of such a configuration that they at least substantially correspond to the contour of the surface portions 13 and 14. The height of the body portions 21 and 22 and the inclination of the bottom surfaces 23 and 24 thereof are such that the top sides or surfaces 25 and 26 of the body portions 21 and 22, in their position of being fitted to the barrel, extend horizontally when the barrel is standing upright, and supplement the also horizontal support surface afforded by the upper end part 3 of the barrel.

FIG. 8 shows another form of a supplementing body portion 29 which is of an integral configuration, with a support surface portion indicated at 30.

It will be noted that the principles of the invention are applicable irrespective of the manner of manufacture of the barrel itself. It is possible for the barrel to be produced by extrusion blow molding, in which case the one or more emptying openings 6 may be disposed in the plane of separation of the divided blow-molding mold and thus on the weld seam indicated at 32 on the upper end part 3 of the barrel, being the seam which closed by means of welding the preform from which the barrel was blow-molded. The extension of the seam is indicated at 33 in FIG. 7. It is however also possible for at least one opening to be arranged outside the weld seam, displaced with respect thereto for example through 90° . The appropriate configuration of the upper end part of the barrel will be clear from the drawing to which reference is accordingly directed.

It will be appreciated that the above-described structures have been set forth solely by way of example and illustration of the principles of the present invention and that various modifications and alterations may be made therein without thereby departing from the spirit and scope of the invention.

What is claimed is:

1. A barrel of thermoplastic material comprising: an upper end part having at least one trough-like depression therein; at least one connecting portion providing an emptying opening and arranged in the respective trough-like depression in the upper end part; at least one ring extending around the barrel at a spacing from the upper end of the barrel; at least one inclined surface on the barrel portion between the upper end part and said ring in the region of the at least one emptying opening and intersecting the trough-like depression between the connecting portion and the ring laterally beside the trough-like depression, the at least one inclined surface being inclined towards the ring when the barrel is standing upright, and the extent of the inclined surface being so selected that in an emptying position of the barrel in which it is inclined through more than 90° relative to its upright position no point in the interior of the barrel is lower than the lowest region of the emptying opening, at the inside wall of the barrel.

2. A barrel as set forth in claim 1 wherein the line of intersection between the inclined surface and the trough-like depression extends at least close to and substantially tangentially with respect to the point of the emptying opening which is towards the inclined surface.

3. A barrel as set forth in claim 1 wherein the inclined surface is arranged to extend substantially symmetrically with respect to the emptying opening.

4. A barrel as set forth in claim 1 wherein the inclined surface goes directly into the side wall of said barrel portion disposed above the ring when the barrel is in an upright position.

5. A barrel as set forth in claim 1 wherein the inclined surface is a substantially flat surface.

6. A barrel as set forth in claim 1 wherein the inclined surface is divided into first and second surface portions along a dividing line extending therebetween at least approximately radially with respect to the barrel cross-section and the emptying opening and wherein the first and second surface portions are arranged to be turned slightly about said dividing line in such a way that on their inward sides they include an angle which is at least slightly less than 180° .

7. A barrel as set forth in claim 6 wherein the surface portions are of a slightly convex configuration on the inward side.

8. A barrel as set forth in claim 1 wherein the inclined surface is divided into first and second surface portions along a dividing line therebetween approximately corresponding to a chord extending through the lowest region of the emptying opening when the barrel is in an emptying position and wherein the first and second surface portions are arranged to be turned slightly about said dividing line in such a way that on their inward sides they include an angle which is at least slightly less than 180° .

9. A barrel as set forth in claim 8 wherein the surface portions are of a slightly convex configuration on the inward side.

10. A barrel as set forth in claim 1 wherein the inclined surface is divided into a first set of first and second surface portions along a dividing line which extends therebetween at least approximately radially with respect to the barrel cross-section and the emptying opening and into a second set of first and second surface portions along a dividing line approximately corresponding to a chord extending through the lowest region of the emptying opening when the barrel is in an emptying position, and wherein the surface portions of each set are each at an angle on the inward side relative to each which is less than 180° .

11. A barrel as set forth in claim 10 wherein the surface portions are of a slightly convex configuration on the inward side.

12. A barrel as set forth in claim 1 and further including a channel-like depression on the inside of the inclined surface in the region between the side wall of the barrel and the emptying opening, the channel-like depression extending substantially radially with respect to the barrel cross-section and the emptying opening.

13. A barrel as set forth in claim 12 wherein the channel-like depression communicates with the emptying opening.

14. A barrel as set forth in claim 1 wherein the inclined surface is of a slightly convexly curved configuration on its inward side.

15. A barrel as set forth in claim 1 wherein the apex of the inclined surface which is at the side wall of the barrel is arranged adjacent said ring.

16. A barrel as set forth in claim 1 wherein a said inclined surface is associated with each opening in the barrel which is suitable for emptying thereof.

17. A barrel as set forth in claim 1 and further including at least one supplementing body portion adapted to be fitted to the barrel with a boundary surface of the supplementing body portion aligned with the surface of said upper end part of the barrel, thereby at least partially to compensate for the reduction in the surface area of the upper end part which extends substantially horizontally when the barrel is standing upright, said reduction resulting from the shaping of the barrel to promote emptying thereof as completely as possible.

18. A barrel as set forth in claim 17 wherein said supplementing body portion is hollow.

19. A barrel as set forth in claim 17 wherein said supplementing body portion is in the form of a blow-molded component.

20. A barrel as set forth in claim 17 wherein the supplementing body portion is in the form of an injection-molded component.

21. A barrel as set forth in claim 17 wherein the surface of the supplementing body portion which is aligned with said surface of the upper end part of the barrel comprises surface portions formed by ribs connected to the supplementing body portion.

22. A barrel as set forth in claim 17 wherein the supplementing body portion is glued to the barrel.

23. A barrel as set forth in claim 17 wherein said supplementing body portion is welded to the barrel.

* * * * *